US005354060A

United States Patent [19]

Wooten

[11] Patent Number: 5,354,060

[45] Date of Patent: Oct. 11, 1994

[54] GOLF PUTTER

[75] Inventor: Richard W. Wooten, Hazlehurst, Ga.

[73] Assignee: The Teardrop Putter Corporation, Hilton Head, S.C.

[21] Appl. No.: 19,531

[22] Filed: Mar. 4, 1993

Related U.S. Application Data

[63] Continuation-in-part of Ser. No. 936,246, Aug. 27, 1992, which is a continuation-in-part of Ser. No. 837,430, Feb. 18, 1992.

[51] Int. Cl.[5] ..... A63B 53/04

[52] U.S. Cl. ..... 273/169; 273/175; 273/167 B; 273/167 C

[58] Field of Search ..... 273/167 C, 164.1, 175, 273/78, 171, 169, 167 E, 167 B; D21/217, 219

[56] References Cited

U.S. PATENT DOCUMENTS

| | | | |
|---|---|---|---|
| D. 138,380 | 7/1944 | Myers et al. | 273/167 C |
| D. 183,180 | 7/1958 | Phillips | 273/164.1 X |
| D. 212,890 | 12/1968 | Rose | D34/5 |
| D. 279,497 | 7/1985 | Brown | D21/219 |
| 823,082 | 6/1906 | Robertson | 273/167 C |
| 1,046,343 | 12/1912 | Smith | 273/164.1 |
| 1,525,137 | 2/1925 | Lawton | 273/175 |
| 2,083,189 | 6/1937 | Crooker | 273/167 E |
| 2,472,978 | 6/1949 | Mahon | 273/175 X |
| 2,826,417 | 3/1958 | Marcoccio | 273/175 X |
| 3,240,497 | 3/1966 | Taylor | 273/171 X |
| 4,043,562 | 9/1977 | Shillington | 273/164 |
| 4,422,638 | 12/1983 | Tucker | 273/78 |
| 4,607,846 | 8/1986 | Perkins | 273/171 |
| 4,881,739 | 11/1989 | Garcia | 273/167 CX |

OTHER PUBLICATIONS

"Without Paying High Pro Shop Prices", p. 25 of Austads Magazine, Putter Advertisements.

*Primary Examiner*—George J. Marlo
*Attorney, Agent, or Firm*—Louis T. Isaf

[57] ABSTRACT

A putter having a putter head that includes a forward portion and a tail portion extending opposite from the forward portion. The forward portion includes a laterally extending, rounded, forward top surface to which a shaft is attached, and a laterally extending, rounded striking surface that extends forward and downward from the forward top surface. The forward portion further includes a laterally extending, planar, forward bottom surface extending rearward from the striking surface. The tail portion is generally coextensive with the forward portion and includes a laterally extending, rounded, tail top surface, and a laterally extending, rounded, tail bottom surface, which terminates in a rearmost tail tip. The putter forward portion defines a forward cavity and the tail portion defines a tail cavity, each of which are filled with lead so as to add weight to the putter head. The overall dimensions and weight distribution of the putter head provide a user of the putter with a unique "touch and feel" when putting. The putter head is balanced and does not "feel", for example, like a piece of pipe at the end of the shaft. When the rounded striking surface comes into contact with a ball, the ball develops overspin. The putter head contains a minimum number of sharp edges that could cause the ball to bounce from the putter head in an uncontrolled manner or result in stubbing. The putter head is resilient and soft and this resilience and softness can be utilized to maximize putting success.

19 Claims, 5 Drawing Sheets

GOLF PUTTER

CROSS-REFERENCES TO RELATED APPLICATIONS

This application is a continuation-in-part of application Ser. No. 07/936,246, filed Aug. 27, 1992; and is a continuation-in-part of application Ser. No. 07/837,430, filed Feb. 18, 1992.

BACKGROUND OF THE INVENTION

The present invention relates generally to the field of equipment used in the sport of golf, and, in its most preferred embodiments, to golf putters.

Putters, and their use while participating in the sport of golf, are well known. The objective of the sport of golf is to project a golf ball toward, and into, a cup partially buried in the earth. The ball is placed on the ground and projected by striking it with a golf club. A golf club includes a club head that is attached to the end of a shaft. The shaft is grasped and swung so that a striking surface of the head contacts the ball, and the ball is driven toward the cup. When the ball is close to the cup and located on a smooth surface, typically called a green, the ball is usually struck with a putter. Putters are designed not to maximize the distance that the ball is projected when struck, but rather, to maximize control over the trajectory of the ball.

There are dozens of differently shaped putters and putter heads, as each designer seeks to provide a striking surface and "touch and feel" that will give the golfer the "best" accuracy, ball control and trajectory. Trajectory of the ball can be improved by imparting overspin on the ball so that the ball does not slide and hop along the ground, but roles smoothly upon it. Overspin can be imparted by striking the ball above the ball centerline or by striking the ball with a rounded striking surface. While various techniques have been employed in an effort to produce a putter that provides the perfect "touch and feel", and superior ball control, many people simply cannot find a putter that has the "touch and feel", and ball control that they desire. Hence, there is a need for a new putter design.

SUMMARY OF THE INVENTION

Briefly described, the present invention comprises a putter, including a shaft connected to a uniquely designed putter head. The putter head includes a forward portion and a tail portion extending opposite from the forward portion. In the preferred embodiments, the forward portion includes a laterally extending, rounded, forward top surface to which the shaft is attached, and a laterally extending, rounded striking surface that extends forward and downward from the forward top surface. The forward portion further includes a laterally extending, planar, forward bottom surface extending rearward from the striking surface. The tail portion includes a laterally extending, rounded, tail top surface, and a laterally extending, rounded, tail bottom surface. The putter forward portion defines a forward cavity and the tail portion defines a tail cavity, each of which are filled with lead so as to add appropriately balanced weight to the putter head.

When the putter is used, the unique design of the putter head causes the putter to function in a manner that increases the odds of successfully putting a golf ball. For example, when the rounded striking surface comes into contact with a ball, the ball is likely to roll freely with no skidding or bouncing off line. In theory, the free rolling develops overspin on the ball which causes the ball to roll longer at a slower average speed near the end of a putt, thus improving the chances of making the putt. Also, there is a smooth, rounded, essentially nonexistent juncture between the striking surface and the forward top surface of the putter head. This effectively extends the striking surface so that, if the putter is erroneously swung and the ball is struck at a position between the striking surface and the forward top surface, or even on the forward top surface, the ball will not contact an edge that could cause the ball to bounce from the putter head in an uncontrolled manner.

Likewise, there is a smooth, rounded juncture between the striking surface and the forward bottom surface. This feature helps precludes stubbing of the putter head against the ground. Also, this effectively extends the striking surface so that, if the putter is erroneously swung and the ball is struck at a position between the striking surface and the forward bottom surface, the ball will not contact an edge that could cause the ball to bounce from the putter head in an uncontrolled manner.

The overall shape and weight distribution of the putter head provide a user of the putter with a unique "touch and feel" when putting. For example, the putter head is balanced to control twisting and can therefore be effectively used with just one hand. Likewise, when the putter is used, the putter head does not "feel", for example, like a piece of pipe at the end of the shaft.

The putter head, in its preferred embodiment, is constructed, in part, from aluminum, which is relatively soft and resilient compared to most other metals. The softness and resilience of the putter head provides a unique "touch and feel". In addition, the shaft is not centered relative to the putter head such that, in the hands of a user, as a ball is struck with the putter head at a greater distance from the shaft, the "effective" softness and resilience is increased. This varying resilience and softness can be utilized to maximize putting success. According to one preferred embodiment, sight marks serve as a scale for judging the relative softness and resilience of the putter head at various positions along the putter head.

It is therefore an object of the present invention to provide a new putter.

Another object of the present invention is to provide a putter that imparts overspin on a golf ball.

Yet another object of the present invention is to provide a putter with a putter head having a shape and weight distribution that provide a user of the putter with a unique "touch and feel".

Still another object of the present invention is to provide a putter head that is not prone to stubbing.

Still another object of the present invention is to provide a putter head having a smooth juncture between a striking surface and a bottom surface.

Still another object of the present invention is to provide a putter head having a smooth, rounded top surface so that the ball will not contact a sharp edge that could cause the ball to bounce from the putter head in an uncontrolled manner.

Other objects, features and advantages of the present invention will become apparent upon reading and understanding this specification, taken in conjunction with the accompanying drawings.

DETAILED DESCRIPTION OF THE PREFERRED EMBODIMENT

Figure 1:
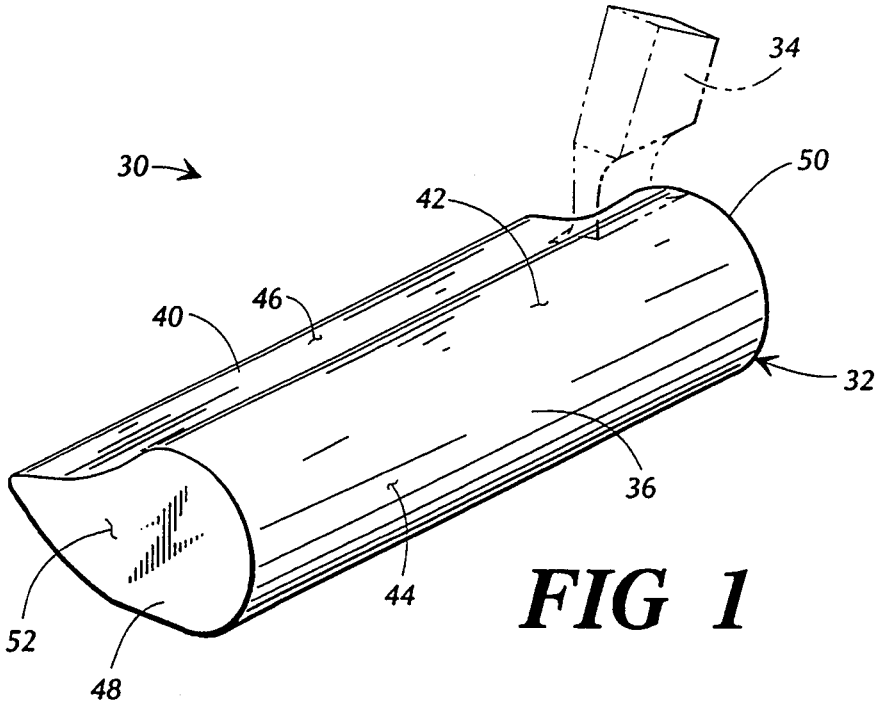
FIG. 1 shows a perspective view of a putter, in accordance with a first preferred embodiment of the present invention, with a portion of the shaft cut away and the remainder of the shaft represented by broken lines.

Referring now in greater detail to the drawings, in which like numerals represent like components throughout the several views, FIG. 1 shows a perspective view of a putter 30, in accordance with a first preferred embodiment of the present invention. The putter 30 includes a putter head 32 and a shaft 34 extending upward from the putter head 32. Throughout the figures, a portion of the shaft 34 is cut away and the remainder of the shaft 34 is represented by broken lines so that the putter head 32 is clearly shown. The putter head 32 includes a forward portion 36 and a tail portion 40 extending opposite from the forward portion 36. The forward portion 36 includes a laterally extending, rounded, forward top surface 42 through which the shaft 34 is attached. The forward portion further includes a laterally extending, rounded striking surface 44 that extends forward and downward from the forward top surface 42. The tail portion 40 includes a laterally extending, rounded, tail top surface 46 that extends rearward from the forward top surface 42., The putter further includes a toe end 48 and a heel end 50. The toe end 48 includes a planar toe surface 52.

Figure 2:
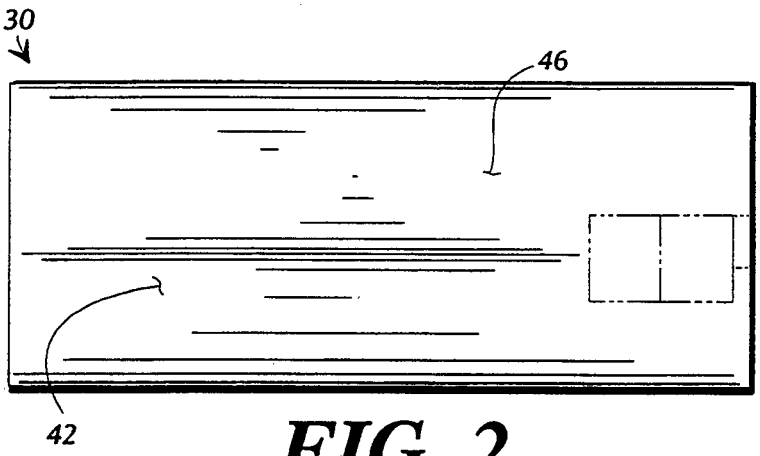
FIG. 2 shows a top view of the putter of FIG. 1.

Referring to FIG. 2, which shows a top view of the putter 30 Of the first preferred embodiment, the forward top surface 42 and tail top surface 46 are clearly seen.

Figure 3:
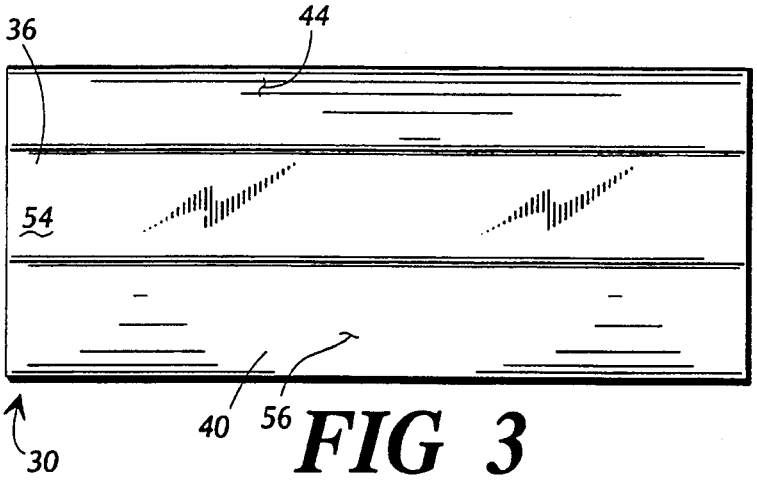
FIG. 3 shows a bottom view of the putter of FIG. 1.

Referring to FIG. 3, which shows a bottom view of the putter 30 of the first preferred embodiment, the forward portion 36 further includes a laterally extending, planar, forward bottom surface 54 extending rearward from the striking surface 44. Also, the tail portion 40 further includes a laterally extending, rounded, tail bottom surface 56.

Figure 4:
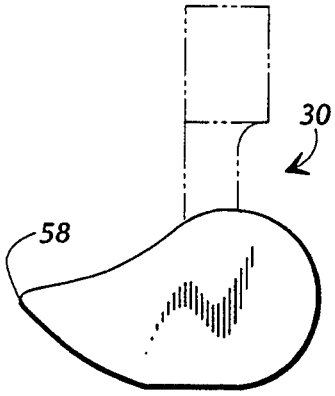
FIG. 4 shows a left side view of the putter of FIG. 1.

Referring to FIG. 4, which shows a left side view of the putter 30 of the first preferred embodiment, the tail top surface 46 (FIG. 1) and tail bottom surface 56 (FIG. 3) join to form a laterally extending tail tip 58.

Figure 5:
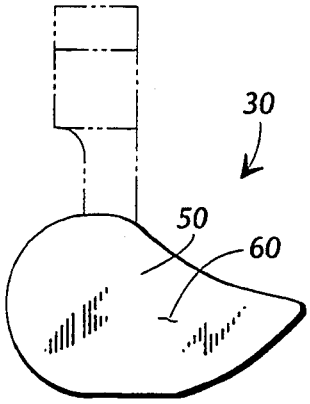
FIG. 5 shows a right side view of the putter of FIG. 1.

Referring to FIG. 5, which shows a right side view of the putter 30 of the first preferred embodiment, the heel end 50 includes a planar heel surface 60. As shown in both FIGS. 4 and 5, in an end elevational view, the putter head 32 generally defines a teardrop shape in which the forward portion 36 defines the generally bulbous portion of the teardrop shape and the tail portion 40 extends and tapers from the forward portion 36 to define the tip of the teardrop shape.

Figure 6:
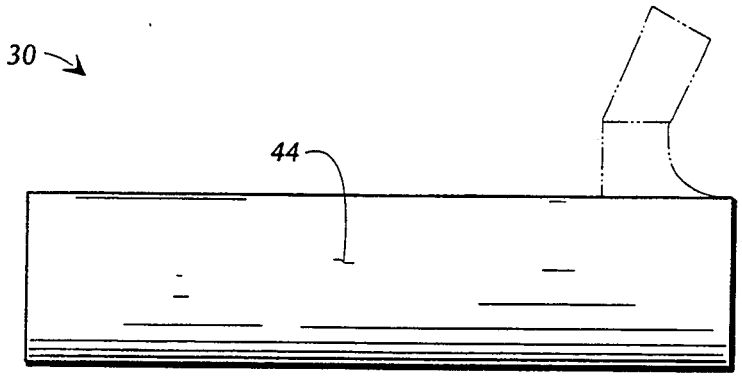
FIG. 6 shows a front view of the putter of FIG. 1.

Referring to FIG. 6, which shows a front view of the putter 30 of the first preferred embodiment, the striking surface 44 is clearly seen.

Figure 7:
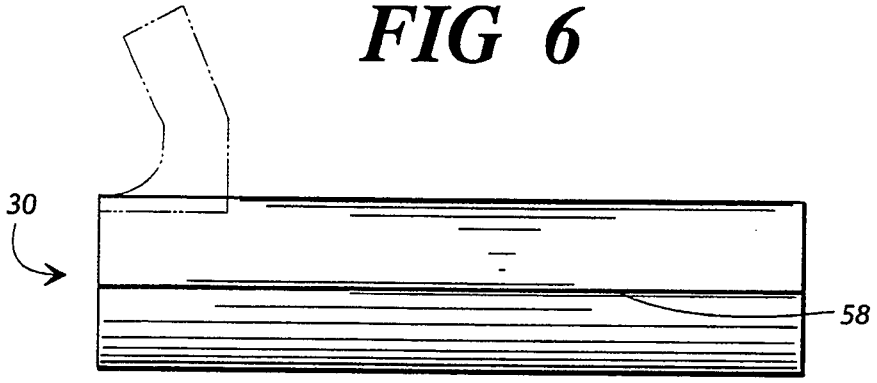
FIG. 7 shows a rear view of the putter of FIG. 1.

Referring to FIG. 7, which shows a rear view of the putter 30 of the first preferred embodiment, the tail tip 58 is clearly seen.

Figure 8:
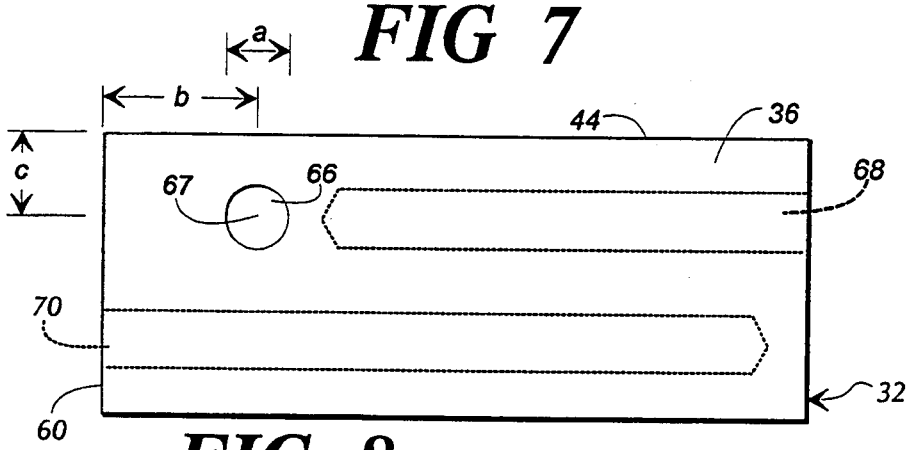
FIG. 8 shows a top view of a putter head, in accordance with the first preferred embodiment of the present invention.

FIG. 8 is a top view of the putter head 32, in accordance with the first preferred embodiment of the present invention. The putter forward portion 36 defines a shaft cavity 66, a shaft cavity centerline 67, and a forward cavity 68 (shown by broken lines). A dimension "a" represents the diameter of the shaft cavity 66. A dimension "b" represents the distance between the heel surface 60 and the shaft cavity centerline 67. A dimension "c" represents the distance between the shaft cavity centerline 67 and a vertical plane tangent to the forward most portion of the striking surface 44. The tail portion 40 defines a tail cavity 70 (shown by broken lines).

Figure 9:
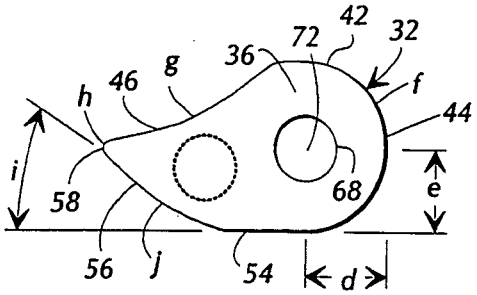
FIG. 9 shows a left side view of the putter head of FIG. 8.

FIG. 9 shows a left side view of the putter head 32 in accordance with the first preferred embodiment of the present invention. The putter forward portion 36 further defines a forward cavity centerline 72. A dimension "d" represents the distance between the forward cavity centerline 72 and the vertical plane tangent to the forward most portion of the striking surface 44. A dimension "e" represents the distance between the forward cavity centerline 72 and a horizontal plane defined by the forward bottom surface 54. An arc "f" is defined by the striking surface 44 and forward top surface 42. An arc "g" is defined by the tail top surface 46. An arc "h" is defined by the tail tip 58. A dimension "i" represents the greatest angle defined between a plane tangent to the tail bottom surface 56 and the horizontal plane defined by the forward bottom surface 54. An arc "j" is defined by the tail bottom surface 56.

Figure 10:
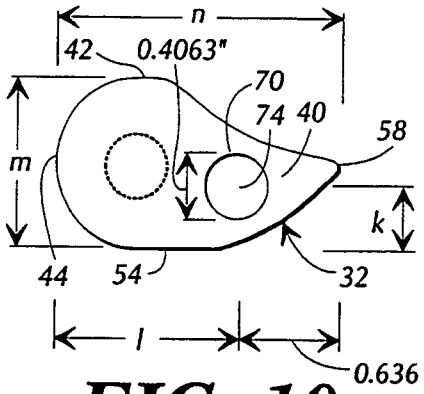
FIG. 10 shows a right side view of a putter head of FIG. 8.

FIG. 10 shows a right side view of the putter head 32 in accordance with the first preferred embodiment of the present invention. The putter tail portion 40 further defines a tail cavity centerline 74. A dimension "k" represents the distance between the tail cavity centerline 74 and the horizontal plane defined by the forward bottom surface 54. A dimension "l" represents the distance between the tail cavity centerline 74 and the vertical plane tangent to the forward most portion of the striking surface 44. A dimension "m" represents the distance between the horizontal plane defined by the forward bottom surface 56 and a horizontal plane tangent to the forward top surface 42. A dimension "n" represents the distance between the vertical plane tangent to the forward most portion of the striking surface 44 and the tail tip 58.

Figure 11:
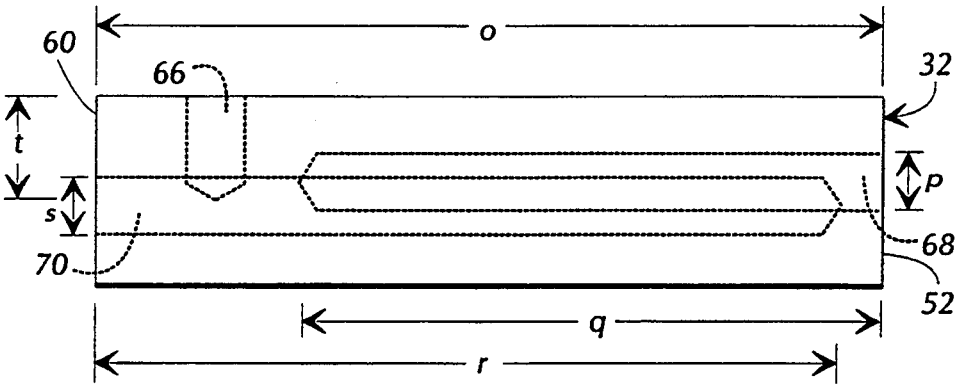
FIG. 11 shows a rear view of a putter head of FIG. 8.

FIG. 11 shows a rear view of the putter head 32 in accordance with the first preferred embodiment of the present invention. A dimension "o" represents the distance between the toe surface 52 and the heel surface 60. A dimension "p" represents the diameter of the forward cavity 68 (shown in broken lines). A dimension "q" represents the length of the forward cavity 68 (shown in broken lines). A dimension "r" represents the length of the tail cavity 70 (shown in broken lines). A dimension "s" represents the diameter of the tail cavity 70 (shown in broken lines). A dimension "t" represents the length of the shaft cavity 66 (shown in broken lines).

Referring back to FIGS. 1–7, there are several methods of using the putter 30 of the first preferred embodiment to increase the odds of successfully putting a golf ball. For example, one method of using the putter 30 of the first preferred embodiment is to grasp the shaft 34 at a location (not shown) away from the putter head 32 in a conventional manner. Then, a sweeping arm motion is utilized to cause the putter striking surface 44 to sweep toward, strike, and propel the ball. Another method of using the putter 30 is to "snap" the wrists such that the putter striking surface 44 "pops" against the ball causing the ball to be propelled.

When the putter 30 is used, the unique design of the putter head 32 causes the putter 30 to function in a manner that increases the odds of successfully putting a golf ball. For example, referring to FIG. 9, the arc "f" defines the rounded striking surface 44 that, when struck against the ball, causes the ball to roll freely with no skidding or bouncing off line. The free rolling develops overspin on the ball. The overspin causes the ball to roll longer at a slow average speed near the end of the putt, thus improving the chances of making the putt. The fact that the arc "f" defines both the striking surface 44 and the forward top surface 42 results in there being a smooth, rounded, essentially nonexistent juncture between the striking surface 44 and the forward top surface 42. This effectively extends the striking surface 44 so that, if the putter 30 is erroneously swung and a ball is struck between the striking surface 44 and the forward top surface 42, or even on the forward top surface 42, the ball will not contact an edge that could potentially cause the ball to bounce from the putter head in an uncontrolled manner.

The arc "f", in conjunction with the fact that forward bottom surface 54 is planar, results in there being a smooth, rounded juncture between the striking surface 44 and the forward bottom surface 54. This feature helps preclude stubbing of the putter head 32 against the ground. If a portion of the striking surface 44 or forward bottom surface 54 contacts the ground, the putter head 32 will simply slide along the ground rather than stub against it. The sliding interaction between the putter head 32 and the ground tends to cause the putter head 32 to become parallel to the ground.

Referring to FIGS. 8–11, the overall dimensions of the putter head 32 ("a" through "t" ) and the distribution of weight in the putter head 32 (discussed below) give the putter 30 special characteristics that provide the user of the putter 30 with a unique "touch and feel" when putting. For example, the putter head 32 is balanced to control twisting toward the forward portion 36 or tail portion 40. Therefore, the putter 30 can be effectively used with just one hand. Likewise, the weight is distributed between the forward portion 36 and tail portion 40 so that when the putter 30 is used, the putter head 32 does not "feel", for example, like a piece of pipe at the end of the shaft 34. Rather, the putter head 32 has a "touch and feel", and balance that builds confidence.

Whereas, within the broad scope of the invention, the putter head 32 is formed of one or more of many different materials as is typical in the industry, in the preferred embodiment, as discussed below, the putter head 32 is constructed, in part, from aluminum. Aluminum is relatively soft and resilient compared to most other metals. In use, the softness and resilience of the putter head 32 provide a unique "touch and feel". Referring to FIG. 1, the softness and resilience of the putter head 32, in combination with the placement of the shaft 34, also provide extra control when putting. The shaft 34 is not centered relative to the putter head 32; therefore, in the hands of a user, as a ball is struck with the putter head 32 at a greater distance from the shaft 34, the "effective" softness and resilience of the putter head 32 is increased. In theory this is due to the fact that the putter head 32 is acting as a cantilever that is fixed to the shaft 34 at, or near, the heel end 50 and is free at the toe end 48. The variation in "effective" resilience and softness can be utilized to maximize putting success. In the hands of a user, control is gained by selectively hitting the ball either toward the heel end 50 or toe end 48 of the putter head 32. In order to facilitate a slow, soft putt, for example when putting down hill, the ball can be struck toward the toe end 40 of the putter head 32.

A preferred method of constructing the putter head 32 of the first preferred embodiment is an extrusion method. Aluminum is extruded through a die to form a rod having, at least, some of the features of the putter head 32. The extruded rod is then cut into sections, and the sections are machined to form the putter head 32. The forward cavity 68, tail cavity 70, and shaft cavity 66 are bored into the putter head 32. The forward cavity 68 and tail cavity 70 are filled with a weighting material, such as lead, in a conventional manner, to add weight to the putter head 32. The tail portion 40 provides a region displaced from the shaft 34 and the tail cavity 70, being defined within the tail portion 40, provides a location for disposing weight at a distance from the shaft 34. Independently, an aluminum shaft 34 is formed, in a conventional manner, and the shaft 34 is inserted into the shaft cavity 66 and rigidly attached to the putter head 32.

Referring back to FIG. 8, the following reflect, for example, acceptable dimensions for the first preferred embodiment of the present invention. The dimension "a" which represents the diameter of the shaft cavity 66, can be 0.3750 inches. The dimension "b", which represents the distance between the heel surface 60 and the shaft cavity centerline 67, can be 0.94 inches The dimension "c" which represents the distance between the shaft cavity centerline 67 and the vertical plane tangent to the forward most portion of the striking surface 44, can be 0.50 inches.

Referring back to FIG. 9, the following reflect, for example, acceptable dimensions for the first preferred embodiment of the present invention. The dimension "d", which represents the distance between the forward cavity centerline 72 and the vertical plane tangent to the forward most portion of the striking surface 44, can be 0.50 inches. The dimension "e", which represents the distance between the forward cavity centerline 72 and the vertical plane defined the forward bottom surface 54, can be 0.50 inches. The radius of curvature for the arc "f", which is defined by the striking surface 44 and forward top surface 42, can be 0.50 inches. The radius of curvature for the arc "g", which is defined by the tail top surface can be 1.50 inches. The radius of curvature for the arc "h", which is defined by the tail tip 58, can be 0.03 inches. The dimension "i", which represents the greatest angle defined between a plane tangent to the tail bottom surface 56 and the horizontal plane defined by the forward bottom surface 54, can be 40.00 degrees. The radius of curvature for the arc "j ", which is defined by the tail bottom surface 56, can be 1.00 inch.

Referring back to FIG. 10, the following reflect, for example, acceptable dimensions for the first preferred embodiment of the present invention. The dimension "k", which represents the distance between the tail cavity centerline 74 and the horizontal plane defined by the forward bottom surface 54, can be 0.3572 inches. The dimension "l", which represents the distance between the tail cavity centerline 74 and the vertical plane tangent to the forward most portion of the striking surface 44, can be 1,074 inches. The dimension "m" which represents the distance between the horizontal plane defined by the forward bottom surface 56 and the horizontal plane tangent to the forward top surface 42, can be 1.00 inch. The dimension "n", which represents the distance between the vertical plane tangent to the forward most portion of the striking surface 44 and the tail tip 58, can be 1.710 inches.

Referring back to FIG. 11, the following reflect, for example, acceptable dimensions for the first preferred embodiment of the present invention. The dimension "o" which represents the distance between the toe surface 52 and the heel surface 60, can be 4.50 inches. The dimension "p", which represents the diameter of the forward cavity 68 (shown in broken lines), can be 0.4063 inches. The dimension "q", which represents the length of the forward cavity 68 (shown in broken lines), can be 3.2 inches. The dimension "r", which represents the length of the tail cavity 70 (shown in broken lines), can be 4.2 inches. The dimension "s", which represents the diameter of the tail cavity 70 (shown in broken lines), can be 0.4063 inches. The dimension "t", which represents the length of the shaft cavity 66 (shown in broken lines), can be 0.63 inches.

Figure 12:
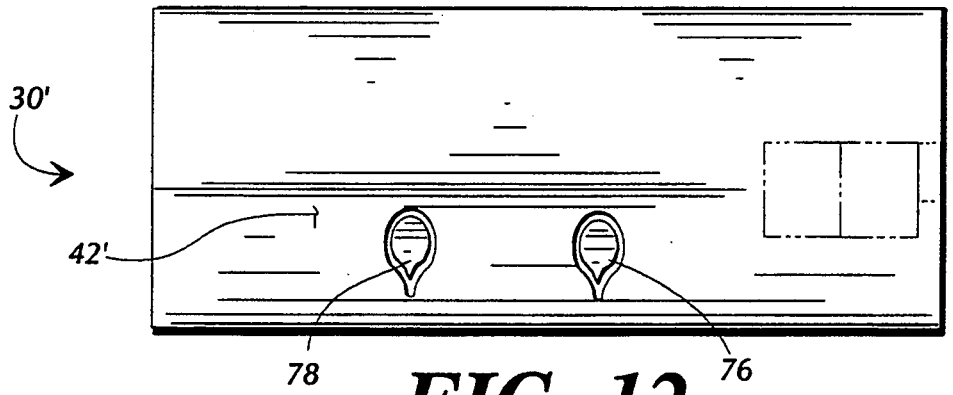
FIG. 12 shows a top view of a putter, in accordance with a second preferred embodiment of the present invention, with a portion of the shaft cut away and the remainder of the shaft represented by broken lines.
Figure 13:
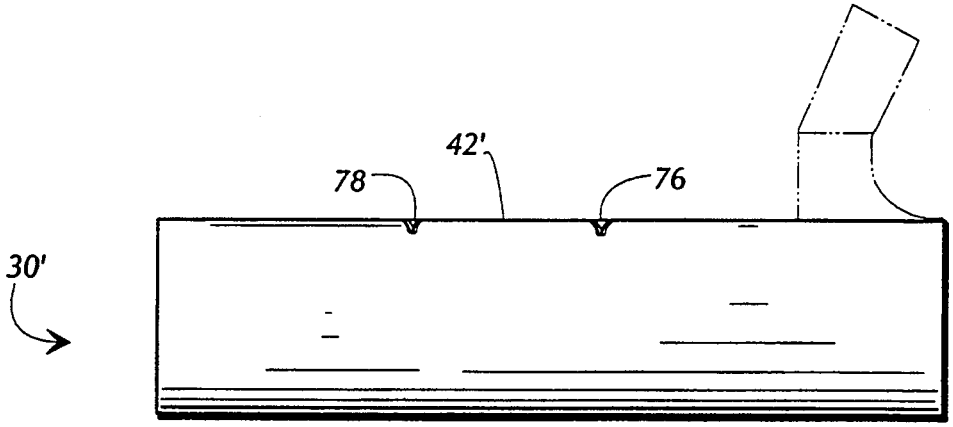
FIG. 13 shows a front view of the putter of FIG. 12.

FIGS. 12 and 13 show top and front views, respectively, of a putter 30' in accordance with a second preferred embodiment of the present invention. The putter 30' of the second preferred embodiment includes a heelward sight mark 76 and a toeward sight mark 78 defined by a forward top surface 42'. Preferably, the sight marks 76,78 are engraved in the forward top surface 42', yet other indicia, such as printing or decals are acceptable. As discussed above, the putter head 32 has a greater "effective" softness and resilience toward the toe end 48 than the heel end 50. By providing a specific reference to the toe end 48 and heel end 50, the toeward sight mark 78 and heelward sight mark 76 serve as a scale for judging the relative softness and resilience of the putter head 32 at different positions along the putter head 32. The sight marks 76,78 are spaced so as to serve as a gauge along the length of the putter head 32, rather than to identify a single preferred strike point. Except for the toeward sight mark 78 and heelward sight mark 76, the putter 30' of the second preferred embodiment is made and used in the same manner as the putter 30 of the first preferred embodiment.

Figure 14:
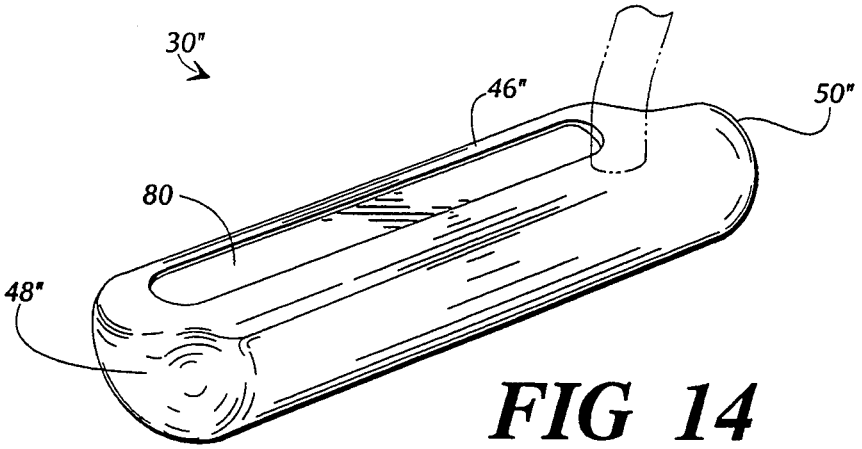
FIG. 14 shows a perspective view of a putter, in accordance with a third preferred embodiment of the present invention, with a portion of the shaft cut away and the remainder of the shaft represented by broken lines.
Figure 15:
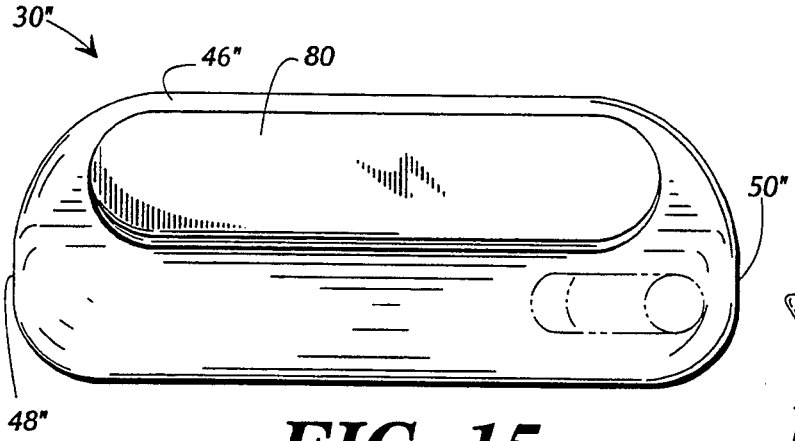
FIG. 15 shows a top view of the putter of FIG. 14.
Figure 17:
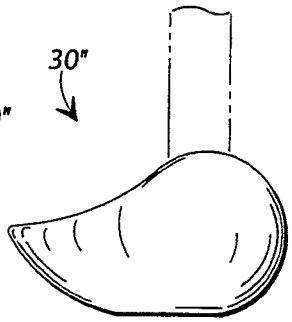
FIG. 17 shows a left side view of the putter of FIG. 14.
Figure 16:
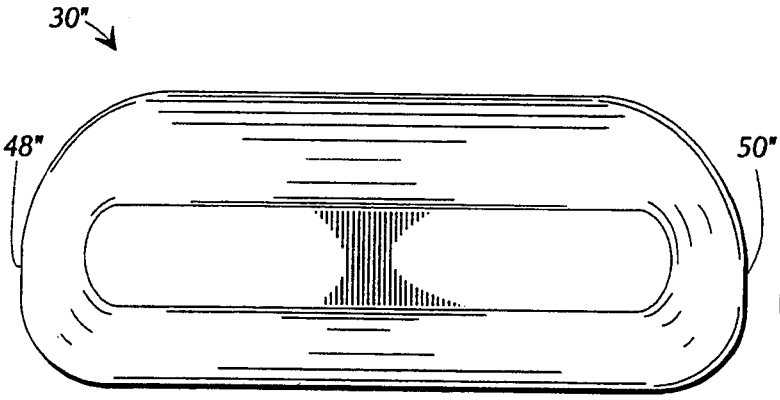
FIG. 16 shows a bottom view of the putter of FIG. 14.
Figure 18:
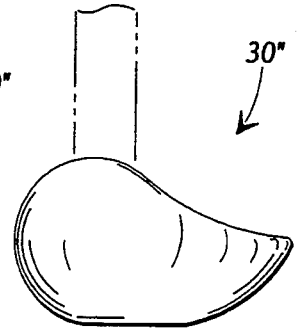
FIG. 18 shows a right side view of the putter of FIG. 14.
Figure 19:
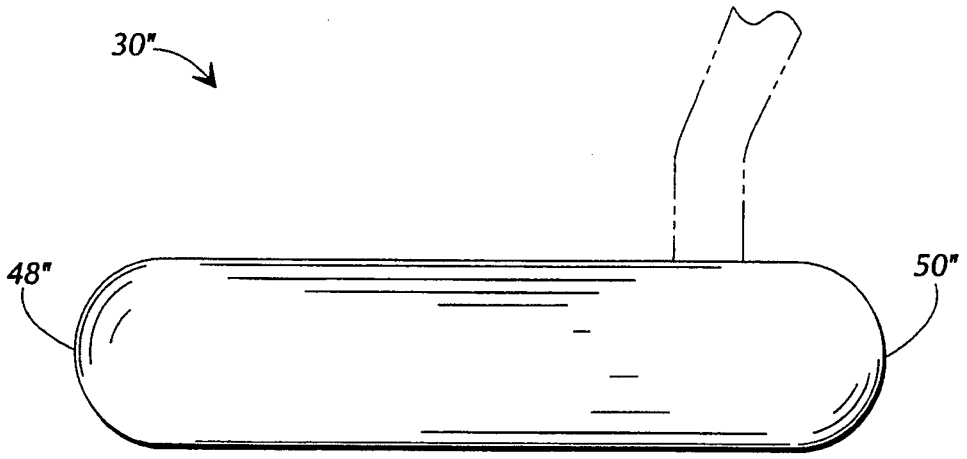
FIG. 19 shows a front view of the putter of FIG. 14.
Figure 20:
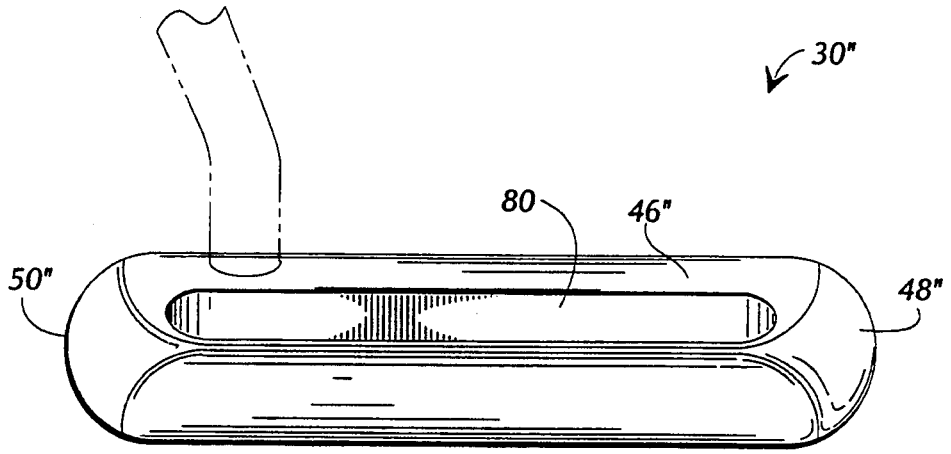
FIG. 20 shows a rear view of the putter of FIG. 14.

FIGS. 14–20 show a putter 30'' in accordance with a third preferred embodiment of the present invention. The putter 30'' of the third preferred embodiment includes a trough 80 defined by a tail top surface 46'' (FIGS. 14, 15, and 20). Also, the putter 30'' of the third preferred embodiment includes a rounded toe end 48'' and a rounded heel end 50'' (FIGS. 14, 15, 16, 19, and 20). The rounded toe end 48'' and rounded heel end 50'' further reduce sharp edges on the putter head 32'' and therefore further reduce any chance that a golf ball might contact an edge that could potentially cause the ball to bounce from the putter head 30'' in an uncontrolled manner. Except for that which is discussed just above, the putter 30'' of the third preferred embodiment is made and used in the same manner as the putter 30 of the first preferred embodiment.

Whereas this invention has been described in detail with particular reference to preferred embodiments and alternate embodiments thereof, it will be understood that variations and modifications can be effected within the spirit and scope of the invention, as described herein before and as defined in the appended claims.

I claim:

1. A putter for putting a golfball, the putter comprising:

a shaft (34) having a handle end and a mounting end; and a putter head (32) rigidly attached to said mounting end of said shaft and including, at least, a laterally elongated vertically thickened forward portion (36), a laterally elongated tail portion (40) generally extending rearward from said forward portion, generally coextensive therewith, and terminating in a rearmost tail tip, and opposite ends (48,50), wherein in an end elevational view, said putter head defines, generally, a teardrop shape in which said forward portion defines the vertically thickened portion of said teardrop shape and said tail portion tapers and extends from said vertically thickened portion of said teardrop shape to define said rearmost tip of said teardrop shape.

2. The putter of claim 1, wherein said forward portion is attached to said mounting end of said shaft.

3. The putter of claim 1, wherein said forward portion defines, at least, a striking surface (44) for engaging the golfball, wherein said striking surface (44) extends laterally between said opposite ends and includes, at least, an upper portion and a lower portion, a forward top surface (42) extending laterally between said opposite ends and extending from said upper portion of said striking surface (44) rearward to said tail portion, and a forward bottom surface (54) extending laterally between said opposite ends and extending from said lower portion of said striking surface (44) rearward to said tail portion, and wherein said tail portion defines, at least, a tail top surface (46) extending laterally between said opposite ends and rearward from said forward top surface (42), and a tail bottom surface (56) extending laterally between said opposite ends and rearward from said forward bottom surface (54), wherein said tail top surface (46) and said tail bottom surface (56) join at a position rearward from said forward portion to form said tail tip (58).

4. The putter of claim 3, wherein said forward top surface (42) and said striking surface (34) define a continuous cylindrical segment, whereby in said end elevational view, said forward top surface (42) and said striking surface (34) define a continuous circular arc.

5. The putter of claim 4,
wherein said tail top surface (46) is concave, and
wherein said tail bottom surface (56) is convex.

6. The putter of claim 5, wherein said forward bottom surface (54) is planar.

7. A putter for putting a golfball, the putter comprising:
a shaft (34) having a handle end and a mounting end; and
a putter head (32) including, at least, a laterally elongated vertically thickened forward portion (36) and a laterally elongated tail portion (40)
extending rearward from said forward portion, generally coextensive therewith, and terminating in a rearmost tail tip,
wherein said forward portion defines, at least,
a striking surface (44) for engaging the golfball,
a forward bottom surface (54), and
a forward cavity (68) within said forward portion,
wherein said forward portion includes, at least, a first portion of weighting material disposed within said forward cavity,
wherein said tail defines, at least, a tail cavity (70) therein,
wherein said tail portion includes, at least, a second portion of weighting material disposed within said tail cavity, and
wherein the putter is constructed and arranged so that in a ball-striking position in which said shaft is substantially vertical and said forward bottom surface (54) is substantially horizontal, the center of mass of said second portion of weighting material is centered rearward from and lower than the center of mass of said first portion of weighting material.

8. The putter of claim 7, wherein said forward portion is attached to said mounting end of said shaft.

9. The putter of claim 7,
wherein said putter head further includes, at least, opposite ends (48,50),
wherein said striking surface (44) extends laterally between said opposite ends and includes, at least, an upper portion and a lower portion,
wherein said forward portion further defines, at least, a forward top surface (42) extending laterally between said opposite end and extending from said upper portion of said striking surface (44) rearward to said tail portion,
wherein said forward bottom surface (54) extends laterally between said opposite ends and extends from said lower portion of said striking surface (44) rearward to said tail portion, and
wherein said tail portion defines, at least,
a tail top surface (46) extending laterally between said opposite ends and extending rearward from said forward top surface (42), and
a tail bottom surface (56) extending laterally between said opposite ends and rearward from said forward bottom surface (54), wherein said tail top surface (46) and said tail bottom surface (56) join at a position rearward from said forward portion to form said tail tip (58).

10. The putter of claim 7, wherein said striking surface (44) is rounded.

11. The putter of claim 10,
wherein said striking surface (44) is rounded and defines an arc having a radius of curvature,
wherein said putter head is defined by an overall depth measured from the forwardmost point of said rounded striking surface (44) to the rearmost tip of said tail portion, and
wherein the center of mass of said second portion of weighting material is located at a distance rearward from said striking surface (44) that is greater than twice said radius of curvature.

12. A putter for putting a golfball, the putter comprising:
a shaft having a handle end and a mounting end; and
a putter head rigidly attached to said mounting end of said shaft and including, at least, a laterally elongated vertically thickened forward portion (36), a laterally elongated tail portion (40) extending rearward from said forward portion, generally coextensive therewith, and terminating in a rearmost tail tip, and opposite ends (48,50),
wherein said forward portion defines, at least,
a striking surface (44) for engaging the golfball, wherein said striking surface (44) extends laterally between said opposite ends and includes, at least, an upper portion and a lower portion,
a forward top surface (42) extending laterally between said opposite ends and extending from said upper portion of said striking surface (44) rearward to said tail portion, and
a forward bottom surface (54) extending laterally between said opposite ends and extending from said lower poriton of said striking surface (44) rearward to said tail portion,
wherein said tail portion defines, at least,
a tail top surface (46) extending laterally between said opposite ends and extending rearward from said forward top surface (42), and
a tail bottom surface (56) extending laterally between said opposite ends and rearward from said forward bottom surface (54), wherein said tail top surface (46) and said tail bottom surface (56) join at a position rearward from said forward portion to form said tail tip (58), and
wherein in an end elevational view of said putter head, while the putter is in a ball-striking position in which said shaft is substantially vertical and said forward bottom surface (54) is substantially horizontal, said tail portion generally defines a wedge-shape by virtue of said tail top surface (46) extending generally upward from said tail tip and said tail bottom surface (56) extending generally downward from said tail tip in a divergent manner, wherein the elevational distance between the bottommost point of said forward bottom surface (54) and the uppermost point of said forward top surface (42) is approximately twice the elevational distance between the bottommost point of said forward bottom surface (54) and said tail tip.

13. The putter of claim 12, wherein said forward portion is attached to said mounting end of said shaft.

14. The golfball putter of claim 12,
wherein said tail top surface (46) is concave, and
wherein said tail bottom surface (56) is convex.

15. The putter of claim 12, wherein said striking surface (34) is rounded.

16. A putter for putting a golfball, the putter comprising:

a shaft having a handle end and a mounting end; and a putter head rigidly attached to said mounting end of said shaft and including, at least, a laterally elongated vertically thickened forward portion (36), a laterally elongated tail portion (40) extending rearward from said forward portion generally coextensive therewith, and terminating in a rearmost tail tip, and opposite ends (48,50), wherein said forward portion defines, at least, a striking surface (44) for engaging the golfball, wherein said striking surface (44) extends laterally between said opposite ends and includes, at least, an upper portion and a lower portion, a forward top surface (42) extending laterally between said opposite ends and extending from said upper portion of said striking surface (44) rearward to said tail portion, wherein said mounting end of said shaft is attached to said forward top surface (42), and a forward bottom surface (54) extending laterally between said opposite ends and extending from said lower portion of said striking surface (44) rearward to said tail portion, wherein said tail portion defines, at least, a tail top surface (46) extending laterally between said opposite ends and extending rearward from said forward top surface (42), and a tail bottom surface (56) extending laterally between said opposite ends and rearward from said forward bottom surface (54), wherein said tail top surface (46) and said tail bottom surface (56) join at a position rearward from said forward portion to form said rearmost tail tip (58), and wherein in an end elevational view of said putter head, while the putter is in a ball-striking position in which said shaft is substantially vertical and said forward bottom surface (54) is substantially horizontal, said tail portion generally defines a wedge-shape by virtue of said tail top surface (46) extending generally upward from said tail tip and said tail bottom surface (56) extending generally downward from said tail tip in a divergent manner such that, where said tail top surface (46) and said tail bottom surface (56) intersect a vertical plane, said vertical plane being at least 0.636 inches forward of said tail tip and extending laterally between said opposite ends, said tail top surface (46) and said tail bottom surface (56) have diverged at least 0.406 inches.

17. The putter of claim 16, wherein said forward portion is attached to said mounting end of said shaft.

18. The golfball putter of claim 16, wherein said tail top surface (46) is concave, and wherein said tail bottom surface (56) is convex.

19. The putter of claim 16, wherein said striking surface (34) is rounded.

* * * * *